United States Patent [19]

Roberts

[11] 3,994,768

[45] Nov. 30, 1976

[54] SUPPORT AND CLEANING MEANS FOR GUIDE FINGERS OF CORRUGATOR

[75] Inventor: Lawrence H. Roberts, Huntington Beach, Calif.

[73] Assignee: S&S Corrugated Paper Machinery Co., Inc., Brooklyn, N.Y.

[22] Filed: Mar. 1, 1976

[21] Appl. No.: 662,715

[52] U.S. Cl. ..... 156/473; 118/203

[51] Int. Cl.[2] ..... B31F 1/00

[58] Field of Search ..... 156/473, 470–472, 156/205–208, 210, 462; 118/203, 252

[56] References Cited

UNITED STATES PATENTS 1,642,782 9/1927 Langston ..... 156/473 X

*Primary Examiner*—David A. Simmons

*Attorney, Agent, or Firm*—Ostrolenk, Faber, Gerb & Soffen

[57] ABSTRACT

Apparatus for producing single face corrugated board is provided with a plurality of guide fingers that support the corrugated web until the liner is applied thereto at the nip between a pressure roll and one of the corrugating roll. A hollow member extending parallel to the roll axes is provided with a plurality of slots wherein the fingers are supported in the region of the aforesaid nip. Air under pressure is introduced into the hollow member and is distributed therefrom to bleed into the slots whereby pressurized air is directed against the guide fingers to limit adhesive buildup thereon.

5 Claims, 2 Drawing Figures

98
71
73
70
72
99
46
44
41
36
29
32
34
38
40
52
49
48
50
58
62
64
54
30
26
28
24
20
16
18
14
10
5
L

SUPPORT AND CLEANING MEANS FOR GUIDE FINGERS OF CORRUGATOR

As described in the A. F. Shields U.S. Pat. No. 2,711,206, issued June 21, 1955 for Corrugator Guide Member, single face board is manufactured by adhesively securing a flat web or liner to the tips of the crowns on one side of a transversely corrugated web. The corrugated web is formed by passing a web between intermeshing fluted corrugating rolls. Guide fingers support the corrugated web in the region extending from the nip between the corrugating rolls and the point where the liner and corrugated web initially engage. In the prior art, each of these fingers has an extensive unsupported length extending to an unsupported free end. Because of this, these fingers often become distorted. Further, adhesive often splashes from the glue roller and builds up excessively on the support fingers to damage the corrugated web.

In order to overcome these difficulties of the prior art the instant invention provides a support for the guide fingers in the region between the glue roll and the pressure roll. This support extends parallel to the roll axis and is constructed with an individual transverse slot for each guide finger. Further, means are provided to introduce pressurized air into these slots for cleaning or preventing buildup of adhesive on the guide fingers.

Accordingly, a primary object of this instant invention is to provide improved support means for the guide fingers of a single facer.

Another object is to provide a support means of this type that is located between the glue and pressure rolls.

Still another object is to provide means for preventing glue buildup on the guide fingers.

A further object is to provide a support means having slots through which single facer guide fingers extend in combination with bleed holes through which pressurized air is introduced into these slots to prevent buildup of glue on the guide fingers.

These objects as well as other objects of this invention shall become readily apparent after reading the following description of the accompanying drawings in which.

Figures 1, 2:
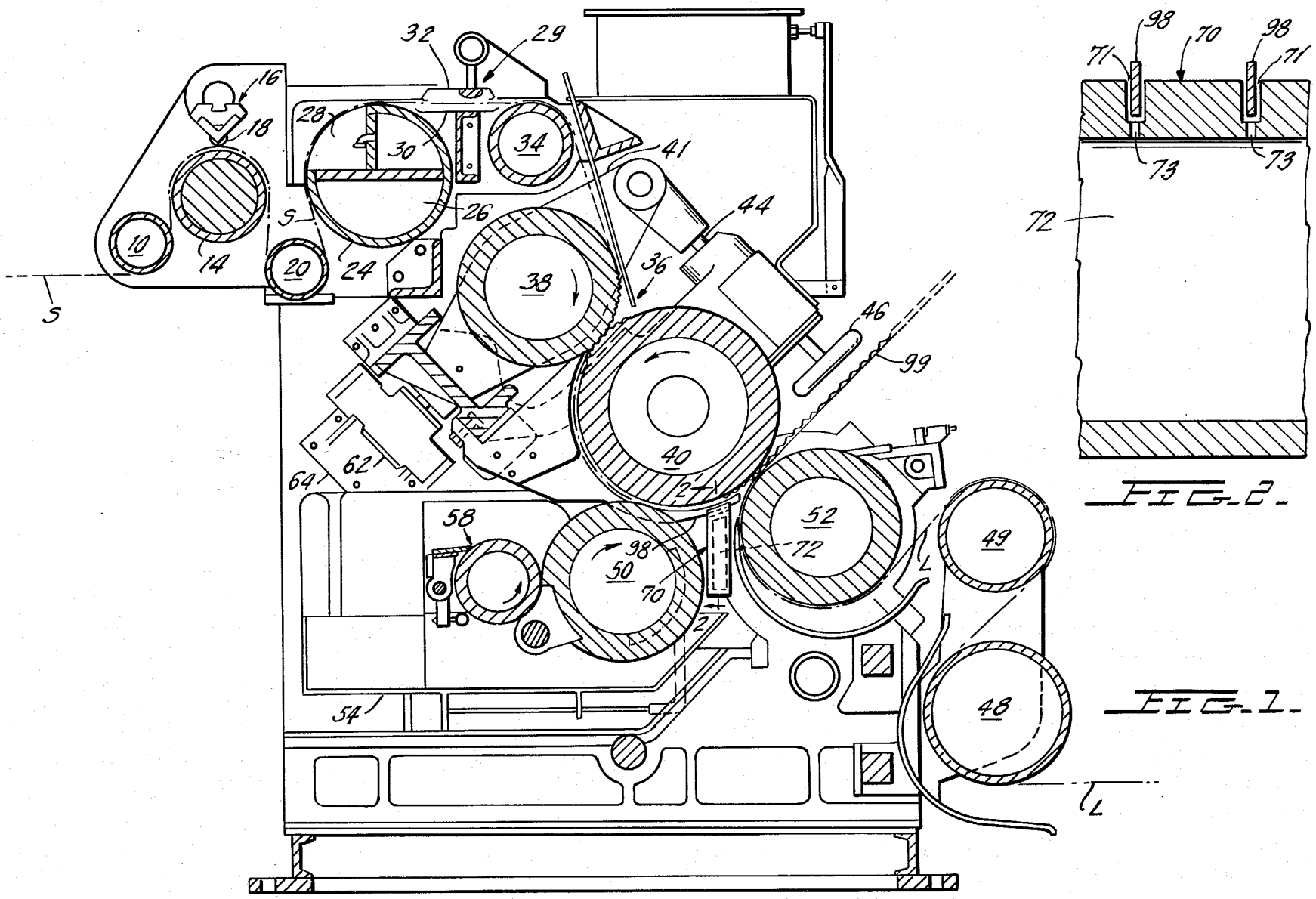
FIG. 1 is a longitudinal section taken through a single facer embodying features of the instant invention.
FIG. 2 is an enlarged cross-section taken through line 2—2 of FIG. 1 located in direction of arrows 2—2.

Now referring to the Figures. Apparatus 100 produces single faced corrugated board 99 which may be a final product or may be delivered to other apparatus for applying another facing to the unfaced side of the corrugated web. In apparatus 100 sheet S to be corrugated is passed over tensioning roll 10 and into sheet trimming assembly 12 including trimming roller 14 and trimming head 16 having a cutting roller 18. Thereafter, sheet S passes over idler roll 22 and sheet moistener assembly 22. The latter embodies steaming roll 24 including steam chest 26 having segmetal cut out 28 over which web S passes. Steam chest 26 is supplied with steam at a proper temperature whereby as the web S passes over the roller 24 web S is preheated and prepared for a corrugating operation. After passing over the roll 24, the web S is fed through guideway 29 including a plate 30 and shield 32 whereupon the web is passed over feed roller 34 positioned above the corrugating unit, generally designated by the reference numeral 36.

Corrugating unit 36 includes a pair of intermeshing corrugating rolls 38, 40 each of which has its external peripheral surface provided with ridges or flutes, which when in engagement along a line of intermeshing, impart corrugations to the web S passing therethrough. Roll 38 is mounted on suitable stationary bearings and is preferably supported for adjustment toward and away from the corrugating roll 40 by means of a pivoted supporting bracket 41 and an adjusting coupling 44 operated from a hand wheel 46 accessible exteriorly of the machine. Suitable provision may likewise be made for adjusting the corrugating rolls 38, 40 axially relative to each other. In many applications the axial adjustment of rolls 38, 40 may be essential to assure that the corrugating rolls have their respective axes in perfect parallelism and with the teeth in exact intermesh to thereby avoid cutting or crushing of web S during high speed operation.

The facing web or liner L is fed toward corrugating roll 40 for assembly with the corrugated web S by suitable pre-heat rollers 48, 49 arranged one above the other. Liner L passes over these rollers prior to being extended about the liner applying or pressure roll 52 arranged in cooperating relation with the corrugating roll 40 along a nip or line of tangency substantially coplanar with the line of intermesh and the respective axes of the rolls 38, 40, 52.

Below corrugating roll 40 and along the feed path upstream of liner applying roll 52 is a silicate or adhesive transfer roller 50, otherwise known as a glue roll, fed with adhesive from pan 54, provision being made for application of a uniform coating of the adhesive or silicate by means of doctoring roller 56 and scraper assembly 58. The silicate or transfer roller 50 applies the adhesive to the crowns of the corrugated web as it passes from the line of intermesh between the corrugating rolls 38, 40 and the line of tangency of the corrugating roll 40 and the liner applying roller 52.

As is apparent to those skilled in the art, the described arrangement is capable of corrugating web S and adhesively securing to one face of the corrugated web a liner L, the resultant moving web of single face board 99 being accessible beyond the corrugating roll 40 and the liner applying roller 52 for further processing, as and for example by providing a liner on the corrugated face opposite the liner L, or for cutting into appropriate lengths.

A guide arrangement is provided for holding the sheet S in the proper relationship with respect to the intermediate corrugating roller 40 during travel of web along the arcuate path from the corrugating roll 38 to the liner applying roll 50. This guide arrangement includes housing 62 supported by plate or bracket 64 on the main upright frame of the single faced corrugating apparatus 100. As explained in detail in the aforesaid U.S. Pat. No. 2,711,206, disposed within housing 62 is an adjusting mechanism (not shown) which supports a plurality of relatively short arcuate strips or guide fingers 88 and a plurality of longer strips or guide fingers 98. The fingers of each plurality 88, 98 are spaced along the roll axes. Short fingers 88 extend toward the nip between corrugating rolls 38, 40 and long fingers 98 extend toward the nip between rolls 40, 52. Fingers 88, 98 are arranged to support corrugated web S as it passes around corrugating roll 40 from corrugating roll 38 to pressure roll 52.

In the region of the nip between rolls 40 and 52, the ends of fingers 98 remote from support bracket 64 extend through guide slots 71 which extend in the direction of web movement. Slots 71 are in the upper surface of hollow support member 70 which is positioned parallel to the axes of rolls 38, 40, 52. The interior of member 70 constitutes a manifold 72 connected to a source of pressurized air (not shown) and communicating with each of the guide slots 71 through an individual narrow passage 73. Thus, pressurized air in manifold 72 bleeds through passages 73 into slots 71 where this pressurized air is directed along the sides of fingers 98 to remove excess adhesive that has splashed on to fingers. While adhesive removal from fingers 98 may not be complete it is sufficient to prevent or at least substantially retard buildup of adhesive fingers 98 to a point where it exceeds a permissible degree above which the quality of board produced is adversely affected. The width of slots 71 is such that the walls of slots 71 guide pressurized air along the sides of fingers 98. Further, this width is chosen to prevent excessive deflection or whipping thin fingers 98 during high speed operation of apparatus 100.

Even though fingers 98 as illustrated in the drawings are not being in contact with the surfaces defining slots 71, the close proximity of fingers 98 to these surfaces enable slots 71 to limit deflection of fingers 98 thereby, in effect, serving to support fingers 98.

While the present invention has been described with reference to one preferred embodiment, many variations and modifications will now become apparent to those skilled in the art. Therefore, this invention is to be limited not by the specific disclosure herein but only by the appended claims.

What is claimed is:

1. Apparatus for producing corrugated board, said apparatus including first and second intermeshing corrugating rolls rotatably mounted on parallel axes, a moving first web guided through a first nip between said corrugating rolls to have transverse corrugations applied thereto, first means for applying adhesive to crowns of corrugations on one side of said first web, a pressure roll rotatably mounted on an axis parallel to said axes and positioned adjacent to said second corrugating roll, a moving second web guided through a second nip between said second corrugating roll and said pressure roll; at said second nip said pressure roll engaging the second web to force it against adhesive covered crowns of said first web, a plurality of guide fingers spaced in a direction parallel to said axes and extending in the direction of movement of said first web and supporting said first web in engagement with said second corrugating roll as said first web travels from said first to said second nips; second means for applying the pressurized air directed at said guide fingers in the vicinity of said second nip for preventing excessive adhesive buildup on said fingers.

2. Apparatus as set forth in claim 1 also including third means extending parallel to said axes and supporting said fingers in the region of said second means.

3. Apparatus as set forth in claim 2 in which the third means includes a plurality of guide slots extending transverse to said axes, said guide fingers being supported in said guide slots.

4. Apparatus as set forth in claim 3 in which the second means directs pressurized air into said guide slots and against said fingers to prevent excessive adhesive buildup thereon.

5. Apparatus as set forth in claim 4 in which the second means includes a manifold on said third means extending generally parallel to said axes and connected to said guide slots by a plurality of bleed apertures.

* * * * *